US005473878A

United States Patent [19]

Hamiel et al.

[11] Patent Number: 5,473,878

[45] Date of Patent: Dec. 12, 1995

[54] HAVING A CORE AND AT LEAST ONE COAXIAL LAYER OF FILAMENTS TWISTED IN THE SAME DIRECTION AT THE SAME PITCH

[75] Inventors: Charles E. Hamiel, Stow; Kenneth M. Kot, Akron, both of Ohio; Johnny D. Massie, II, Lexington, Ky.; Kenneth J. Palmer, Wadsworth; Italo M. Sinopoli, Canton, both of Ohio

[73] Assignee: The Goodyear Tire & Rubber Company, Akron, Ohio

[21] Appl. No.: 36,951

[22] Filed: Mar. 25, 1993

[51] Int. Cl.[6] ..... D07B 1/06

[52] U.S. Cl. ..... 57/213; 57/902

[58] Field of Search ..... 57/212, 213, 214, 57/218, 219, 902

[56] References Cited

U.S. PATENT DOCUMENTS

| | | | |
|---|---|---|---|
| 3,032,963 | 5/1962 | Fenner | 57/902 X |
| 3,538,702 | 10/1969 | Wolf et al. | 57/145 |
| 3,726,078 | 4/1973 | Nakamura | 57/902 X |
| 3,834,149 | 9/1974 | Nibet | 57/213 |
| 4,506,500 | 3/1985 | Miyauchi et al. | 57/902 X |
| 4,608,817 | 9/1986 | Brandyberry et al. | 57/213 |
| 4,707,975 | 11/1987 | Umezawa | 57/902 X |
| 4,783,955 | 11/1988 | Uchio | 57/902 X |
| 4,788,815 | 12/1988 | Umezawa | 57/902 X |
| 5,050,657 | 9/1991 | Umezawa | 57/213 X |
| 5,327,713 | 7/1994 | Sakon | 57/213 |

*Primary Examiner*—William Stryjewski

*Attorney, Agent, or Firm*—T. P. Lewandowski; Howard M. Cohn

[57] ABSTRACT

The invention is directed to several embodiments of metallic cord for the reinforcement of tires wherein one or more coaxial layers of metallic filaments are arranged around the metallic core filaments and twisted in the same direction at the same pitch. In one embodiment, the ratio of the diameter of the core filaments to the layer filaments is at least 1.28. In another embodiment, two of the core filaments have a first diameter and the third core filament has a second diameter smaller than the first diameter daimeter. In still another embodiment, two of the core filaments have a first diameter and a third of the core filaments has a second diameter smaller than the first diameter while the coaxial layer filaments have a third diameter equal to the second diameter. In another embodiment, the core has three core filaments twisted about each other and a coaxial layer of eight layer filaments arranged around the core filaments. In yet another embodiment, the core filaments have a first diameter and the layer filaments have a second diameter which is larger than the first diameter.

10 Claims, 1 Drawing Sheet

HAVING A CORE AND AT LEAST ONE COAXIAL LAYER OF FILAMENTS TWISTED IN THE SAME DIRECTION AT THE SAME PITCH

BACKGROUND OF THE INVENTION

While the invention is subject to a wide range of applications, it particularly relates to metal cord, such as that used to reinforce elastomers. More particularly, the present invention is directed to a single strand cord of compact construction used to reinforce tires.

It is known to manufacture single strand, metal cord in a single operation wherein conventional cord is made of filaments having the same diameter twisted together in the same direction and having the same lay length. The cord is said to have a compact cross section which is generally the same over the length of the cord. The filaments in the cross section are arranged in concentric layers in which the filaments are tangential to all the filaments surrounding an individual filament. The single operation produces a cord having a single, compact strand. The single strand, compact cord has the advantages of a reduced cord diameter. These advantages include: (1) a calendared ply having a reduced thickness and therefore requiring less calender rubber; (2) a potential increase in the ends per inch for a given width of ply; and (3) an increased ply strength resulting from an increase in the ends per inch. The uniform cross section is thought to more uniformly distribute the load carried by the cord to each individual filament. The result is a higher breaking load. Further, the cord is thought to have improved fatigue resistance and greater flexibility.

In a conventional pneumatic radial tire using steel cords, as described above for reinforcement, the fatigue properties of the carcass ply and belt layer are degraded mainly by material fatigue due to repeated strain and fretting wear in the contact portion between adjacent filaments. Both of these problems, as discussed in U.S. Pat. Nos. 4,707,975 ('915) and 4,788,815 ('815), are said to be alleviated by penetration of rubber into the inside of the cord. Then, the rubber layer interposed between the steel filaments prevents rubbing between adjacent filaments, the so called "fretting wear".

The penetration of the rubber is difficult to achieve in multi-layer, structured cords. When some of the filaments are not covered with rubber due to incomplete rubber penetration, the fatigue properties of the cord are not substantially improved. The '915 and '815 patents attempt to overcome this problem by forming a central base structure composed of 1 to 4 steel filaments with a larger diameter than the diameter of each of the plurality of steel filaments forming at least one coaxial layer arranged around the central base structure so as to adjoin them to each other. All of the steel filaments are twisted in the same direction at the same pitch.

A modification of the above described conventional cord is set forth in U.S. Pat. No. 4,608,817 ('817), assigned to The Goodyear Tire and Rubber Co, a common assignee with the present invention. In the '817 patent, a structural relationship exits between the core and the surrounding layers of the cord. That is, a single strand of metal cord is produced from filaments of a similar diameter twisted together in the same direction and having the same lay length. The cord is constructed of a core of two or more filaments; at least one layer of filament placed on and about the core; and at least one filament in the core being positioned so that the filaments in first layer are next to the core. Further, at least one filament in the first layer may be positioned with the filaments in the second layer, or each additional layer of filaments may have at least one filament from the adjacent inner layer positioned with the filaments in each additional layer. The cord constructions can be expressed generally by N+(N+X)+(N+X+Y), where N is the number of filaments in the cord core and is greater than 1, (N+X) is the number of filaments laid on the core filaments where $1<X<6$, and (N+X+Y) is the number of filaments on the (N+X) number of filaments where $0<Y<7$. Additional filaments can be laid on as above in accordance with the series N+Y+X+Y, etc. and a fewer number of filaments can be expressed simply by N+(N+X) within the ranges given above for X and Y. An example of a cord using the above expression would be a 27X where N=5, X=3, and Y=6 to give 5+(5+3)+(5+3+6) or 5+8+14.

OBJECTS AND SUMMARY OF THE INVENTION

It is an advantage of the present invention to provide an steel cords for the reinforcement of tires that obviates one or more of the limitations and disadvantages of the described prior arrangements.

It is a further advantage of the present invention to provide steel cords for the reinforcement of tires which have improved interlocking between all of the filaments forming the cord as well as improved mechanical cord properties.

According to the present invention, a metallic cord for the reinforcement of elastomer used in the manufacture of tires comprises a core composed of three metallic core filaments twisted about each other. A coaxial layer of nine metallic layer filaments is arranged around the core filaments and the metallic core and layer filaments are twisted in the same direction at the same pitch. The three metallic core filaments have a first diameter (dc) of 0.23 mm. and the metallic layer filaments have a second diameter (dl) of 0.18 mm. which is smaller than the first diameter (dc). The ratio of the first diameter to the second diameter (dc)/(dl) is at least 1.28.

In accordance with the invention, a second embodiment of metallic cord for the reinforcement of elastomer used in the manufacture of tires comprises a core composed of three metallic core filaments twisted about each other and a coaxial layer of nine metallic layer filaments arranged around the core filaments. The metallic core and layer filaments are twisted in the same direction at the same pitch. Two of the metallic core filaments have a first diameter (dc) of 0.22 mm and the third metallic core filament has a second diameter (dcs) of 0.20 mm smaller than the first diameter (dc). The metallic layer filaments have a third diameter (dl) of 0.20 mm equal to the second diameter (dcs).

Also in accordance with the invention, a third embodiment of metallic cord for the reinforcement of elastomer used in the manufacture of tires comprises a core composed of three metallic core filaments twisted about each other and a coaxial layer of eight metallic layer filaments arranged around the core filaments. The metallic core filaments and the metallic layer filaments are twisted in the same direction at the same pitch. Two of the metallic core filaments have a first diameter (dc) of 0.22 mm and a third of the metallic core filaments has a second diameter (dcs) of 0.20 mm, smaller than the first diameter (dc). The metallic layer filaments of the coaxial layer have a third diameter (dl) of 0.20 mm equal to the second diameter (dcs).

Further in accordance with the invention, a fourth embodiment of metallic cord for the reinforcement of elastomer used in the manufacture of tires comprises a core composed of three metallic core filaments twisted about each other and a coaxial layer of six metallic layer filaments arranged around the core filaments. The metallic core filaments and the metallic layer filaments are twisted in the same direction at the same pitch. The metallic core filaments have a first diameter (dc) of 0.21 mm and the metallic layer filaments of the coaxial layer have a second diameter (dl) of 0.23 mm which is larger than the first diameter (dc).

According to the invention, a fifth embodiment of metallic cord for the reinforcement of elastomer used in the manufacture of tires comprises a core composed of three metallic core filaments twisted about each other and a coaxial layer of six metallic layer filaments arranged around the core filaments. The metallic core filaments and the metallic layer filaments are twisted in the same direction at the same pitch. The metallic core filaments have a first diameter (dc) of 0.18 mm. The coaxial layer of six metallic layer filaments includes a first group of three which have a second diameter (dl) greater than the first diameter (dc) and a second group of three having a third diameter (dls) greater than the first diameter (dc) and less than second diameter (dl). The filaments of the first and second groups are interposed between each other. The first diameter (dc) is mm, the second diameter (dl) is 0.22 mm and the third diameter (dl) is 0.20 mm.

Also in accordance with the invention, a sixth embodiment of metallic cord for the reinforcement of elastomer used in the manufacture of tires comprises a core composed of three metallic core filaments twisted about each other and a coaxial layer of eight metallic layer filaments arranged around the core filaments. The metallic core and layer filaments are twisted in the same direction at the same pitch. The metallic core filaments have a first diameter (dc) and the metallic layer filaments of the coaxial layer have a second diameter (dl) equal to the first diameter (dc). Preferably, the first diameter (dc) is 0.20 mm and the second diameter (dl) is 0.20 mm.

BRIEF DESCRIPTION OF THE DRAWINGS

The invention and further developments of the invention are now elucidated by preferred embodiments shown in the drawings.

DETAILED DESCRIPTION OF THE INVENTION

Figure 1:
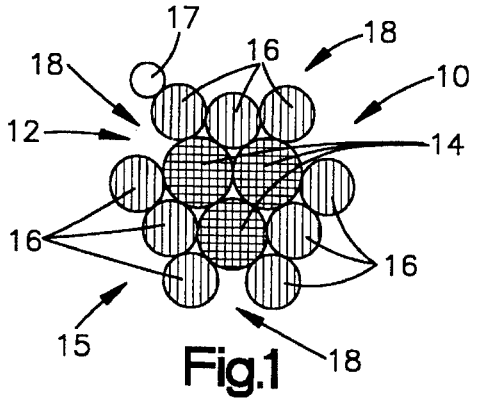
FIG. 1 is a schematic cross sectional view of a first embodiment of a cord in accordance with the present invention.

Referring to FIG. 1, there is illustrated a 3×0.23/9×0.18+1 cord 10 being constructed of a core 12 formed of three cord filaments 14, each with a diameter (dc) of 0.23 mm; and a coaxial layer 15 of nine layer filaments 16, each with a diameter (dl) of 0.18 mm, laid on the core 12 to give a total of twelve filaments. The twelve filaments, three metallic core filaments 14 and nine metallic layer filaments 16 are twisted together in the same direction at the same pitch. Each of the filaments is preferably formed of a high strength, high carbon steel having a strength between about 3700 through 4000 Mega Pascal. A spiral wrap of a small wrap filament 17 of steel can be arranged about the coaxial 15 to hold it together and in position against core 12, if desired. The spiral wrap is preferably a 0.15 mm diameter wrap filament of high carbon steel.

Since the twelve filaments are all twisted together, the core filaments 14 are interlocked within the layer 15 to prevent relative motion between the core 12 and the layer 15. Spacings 18 between the layer filaments 16, allow for direct contact of the core 12 with the calendar elastomer or rubber, which is typically applied to the cord. The terms "elastomer" and "rubber" are used interchangeably throughout this specification. That is, a large surface area of layer filaments 16 is exposed, while at the same time exposing the core filaments 14 to significant rubber penetration. The effectiveness of the rubber penetration into the spacing 18, the increased area of contact between the rubber of the filaments, and the tying of the cord filaments together by the rubber disposed between them further enhances the interlocking between the cord filaments.

To achieve the effective rubber penetration and the advantages enumerated above, it has been found advantageous for the three metallic core filaments 14 to have the same diameter (dc) while the metallic layer filaments 16 have a diameter (dl) smaller than the diameter (dc) wherein the ratio of (dc)/(dl) is at least 1.28.

Figure 7:
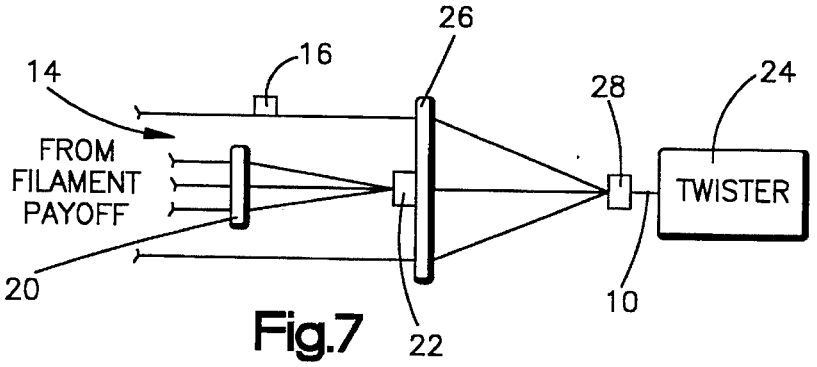
FIG. 7 is a schematic of apparatus for making the cord embodiments as illustrated in FIGS. 1–6.

Referring to FIG. 7, there is illustrated a schematic of an apparatus generally of the type for manufacturing the various cord embodiments disclosed herein. All of the cord filaments come from a payoff, e.g. a bank of individual spools (not illustrated). The core filaments 14 pass through equally spaced, circumferentially distributed holes in a first organizer plate 20. The plate 20 may have a similar set of holes spaced radially outward for the nine layer filaments 16 when one plate is used. Each set of holes maintains the filaments therein uniformly spaced in a circular pattern. Following the plate 20, the core filaments 14 pass through a first closing die 22 where they are gathered and receive a suitable number of turns from a twister 24, which can be a rotating flyer, or any mechanism for applying turns to the filaments. Preferably, the nine layer filaments 16 pass through a second organizer plate 26 having circumferentially spaced holes for the nine filaments. Following organizer plate 26, three of the core filaments 14 and the nine layer filaments 16 pass through a second closing die 28 where the filaments 16 are uniformly laid onto the core to form the finished shape of the cord with a generally uniform cross section over its length.

Figure 2:
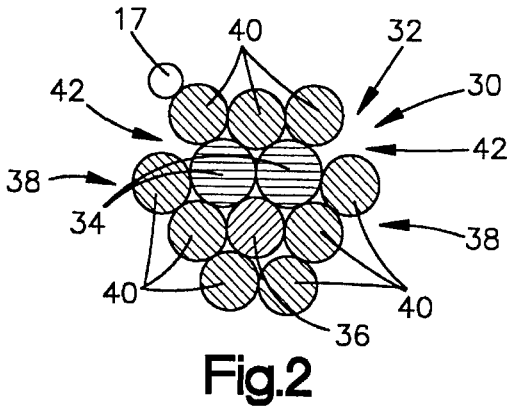
FIG. 2 is a schematic cross sectional view of a second embodiment of a cord in accordance with the present invention.

Referring to FIG. 2, there is illustrated a second embodiment of the invention wherein a 2×0.22/1×0.20/9×0.20+1 cord 30 having a construction of a core 32 formed of two core filaments 34, each with a diameter (dc) of 0.22 mm; a third core filament 36 with a diameter (dcs) of 0.20 mm; and a coaxial layer 38 of nine layer filaments 40, each with a diameter (dl) of 0.20 mm, laid on the core 32 to give a total of 12 filaments. The twelve filaments, three metallic core filaments 34, 36 and nine metallic layer filaments 40 are twisted together in the same direction at the same pitch. Each of the filaments is formed of a high strength, high carbon steel. A spiral wrap of a small wrap filament 17 of steel can be arranged about the layer 38 to hold it together and in position against core 32, if desired.

The cord 30 of the second embodiment is similar to the cord 10 of the first embodiment, as illustrated in FIG. 1, in that both cords 10 and 30 are constructed from the same number of filaments and by the same manufacturing process as discussed above and illustrated in FIG. 7. The difference between the cord 10 of the first embodiment and the cord 30 of the second embodiment is that the core 32 of cord 30 is formed of two core filaments 34 with the same diameter (dc) and a third core filament 36 with a smaller diameter (dcs) than the other two core filaments 34. Further, the diameter (dl) of the nine layer filaments 40, constituting the outer layer 38, is the same as the diameter (dcs) of third core filament 36. The cord 30, constructed with the size relationships afforded by the selection of these cord and layer filament sizes, is two spacings 42 between layer filaments 38 which allows for direct contact of the core 32 with the calender rubber conventionally applied to the cord 30. That is, a large surface area of the layer filaments 38 is exposed, while at the same time exposing the core filaments 34 to significant rubber penetration. The rubber penetration into the spacings 42, between the layer filaments 40 and the core 32, due to the relationship of the sizes of the core filaments 34 and 36 and the layer filaments 38, has been found to provide effective interlocking between the filaments forming the cord 30.

Figure 3:
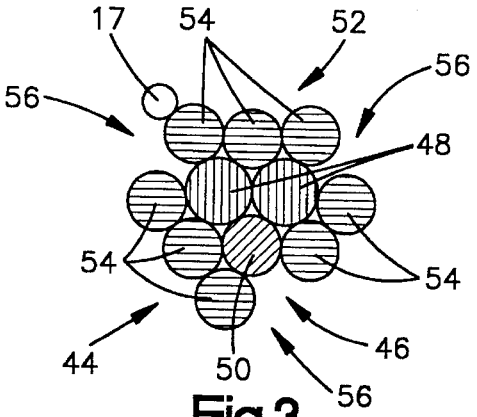
FIG. 3 is a schematic cross sectional view of a third embodiment of a cord in accordance with the present invention.

Referring to FIG. 3, there is illustrated a third embodiment of the invention wherein a 2×0.22/1×0.20/8×0.20+1 cord 44 having a construction of a core 46 formed of two core filaments 48, each with a diameter (dc) of 0.22 mm and a third core filament 50, with a diameter (dcs) of 0.20 mm; and a coaxial layer 52 of eight layer filaments 54, each with a diameter (dl) of 0.20 mm, laid on the core 46 to give a total of eleven filaments. The eleven filaments, three metallic core filaments 48, 50 and eight metallic layer filaments 54, are twisted together in the same direction at the same pitch. Each of the filaments of cord 44 is formed of high strength, high carbon steel. A spiral wrap of a small wrap filament 17 of steel can be arranged about the coaxial layer 52 to hold it together and in position against core 46, if desired.

The cord 44 of the third embodiment is similar to the cord 30 of the second embodiment, in that both cords 30 and 44 are constructed from the same sized filaments and by the same manufacturing process as discussed above and illustrated in FIG. 7. The difference between the cord 30 and cord 44 is that core 46 of the third embodiment is formed of three filaments having two different sized filaments and its associated layer 52 is formed of eight layer filaments 54 with the same diameter instead of nine layer filaments 38 with the same diameter, as in cord 30. The result of constructing cord 44 with the size relationships afforded by the selection of the core and layer filament sizes and the number of layer filaments is three spacings 56 between the layer filaments 54 which allows for direct contact of the core 46 with the calender rubber conventionally applied to the cord 44. That is, a large surface area of layer filaments 54 is exposed, while at the same time exposing the core filaments 48 and 50 to significant rubber penetration. The rubber penetration into the spacings 56 due to the relationship of the sizes of the core filaments 48 and 50 and the layer filaments 54, has been found to provide effective interlocking between all of the filaments forming the cord 30.

Figure 4:
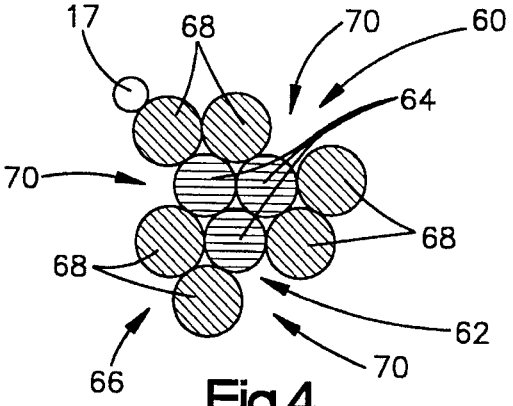
FIG. 4 is a schematic cross sectional view of a fourth embodiment of a cord in accordance with the present invention.
Figure 5:
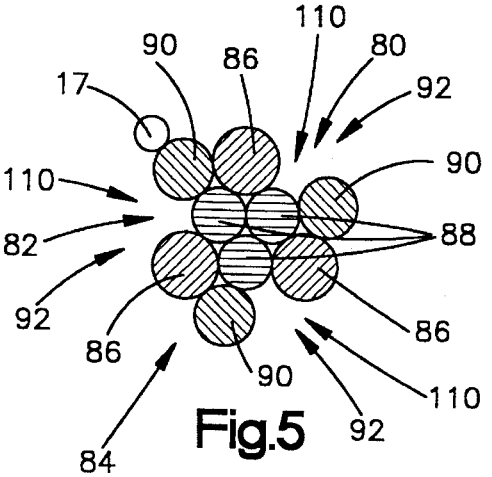
FIG. 5 is a schematic cross sectional view of a fifth embodiment of a cord in accordance with the present invention.

Referring to FIG. 4, there is illustrated a fourth embodiment of the invention wherein a 3×0.21/6×0.23+1 cord 60 having a construction of a core 62 formed of three core filaments 64, each with a diameter (dc) of 0.21 mm and a coaxial layer 66 of six layer filaments 68, each with a diameter (dl) of 0.23 mm, laid on the core 62 to give a total of nine filaments. The nine filaments, three metallic core filaments 64 and six metallic layer filaments 68, are twisted together in the same direction at the same pitch. Each of the filaments of cord 60 is formed of high strength, high carbon steel. A spiral wrap of a small wrap filament 17 of steel can be arranged about the coaxial layer 66 to hold it together and in position against core 62, if desired.

The cord 60 of the fourth embodiment is similar to the first, second and third embodiments previously discussed because the cords 10, 30, 44, and 60 are each constructed by the same manufacturing process as discussed above and schematically illustrated in FIG. 7. The difference between the cord 60 of the fourth embodiment and the other cords 10, 30, and 44 of the first, second and third embodiments is that the coaxial layer 66 of cord 60 is formed of only six layer filaments 68 and the core 62 is formed of three core filaments 64. Moreover, the three core filaments 64 each have a smaller diameter (dc) than each of the six layer filaments 68 (dl). It has been found advantageous for the three metallic core filaments 64 to have the same diameter (dc) while the six metallic layer filaments 68 of the coaxial layer 66 have a diameter (dl) larger than the diameter (dc) wherein the ratio of (dc)/(dl) is 0.91. The result of constructing cord 60 with the size relationships afforded by the selection of the core and layer filament Sizes and the number of layer filaments is three openings 70 between the layer filaments 68 which allows for direct contact of the core 62 with the calender rubber conventionally applied to the cord 60. That is, a large surface area of the layer filaments 68 is exposed, while at the same time exposing the core filaments 64 to significant rubber penetration. The rubber penetration into the openings 70, between the coaxial layer 66 and the core 62, due to the relationship of the sizes of the core filaments 64 and the layer filaments 68, has been found to provide effective interlocking between all of the filaments forming the cord 60.

The 3×0.18/3×0.22/3×0.20+1 cord 80 of the fifth embodiment is similar to the fourth embodiment, discussed above, because the cords 60 and 80 have the same number and configuration of filaments forming the cores 62 and 82 and the coaxial layers 66 and 84, respectively, thereabout. Also both cords 60 and 80 are constructed by the same manufacturing process as discussed above and illustrated in FIG. 7. The difference between the cord 80 of the fifth embodiment and cord 60 of the fourth embodiment is that the coaxial layer 84 of cord 80 is formed of first and second groups of layer filaments 86 and 90. The first group of three metallic layer filaments 86 have a diameter (dl) greater than the diameter (dc) of the three metallic core filaments 88 constituting the core 82 and the second group of three metallic layer filaments 90 are each disposed between two of the metallic layer filaments 86 in the first group and have a diameter (dls) greater than the diameter (dc) of the metallic core filaments 88 but smaller than the diameter (dl) of each of the three metallic layer filaments 86.

The metallic core filaments 88 of cord 80 each having a diameter (dc) of 0.18 mm. The first group of metallic layer filaments 86, which are coaxially disposed about the core 82, each have a diameter (dl) of 0.22 mm. The second group of metallic layer filaments 90, which are also coaxially disposed about the core 82 and interposed between two of the metallic layer filaments 86 in the first group, each have diameter (dls) of 0.20 mm. The coaxial layer 84 laid on the core 82 together with the core 82 gives a total of nine filaments. The nine filaments, three metallic core filaments and six metallic layer filaments 88,90 are twisted together in the same direction at the same pitch. Each of the filaments of cord 80 is formed of high strength, high carbon steel. A spiral wrap of a small wrap filament 17 of steel can be arranged about the coaxial layer 84 to hold it together and in position against core 82, if desired.

The construction of cord 80, with the size relationships of the core 82 and layer filament sizes and the number of layer filaments, provides three openings 92 between the layer filaments 86,90 which allows for direct contact of the core 82 with the calender rubber conventionally applied to the cord 80. That is, a large surface area of the layer filaments 86, 90 is exposed, while at the same time exposing the core filaments 88 to significant rubber penetration. The rubber penetration into the openings 92, between the coaxial layer filaments 86 and 90, due to the relationship of the sizes of the core filaments 88 and the layer filaments 86, 90, has been found to provide effective interlocking between all of the filaments forming the cord 80.

Figure 6:
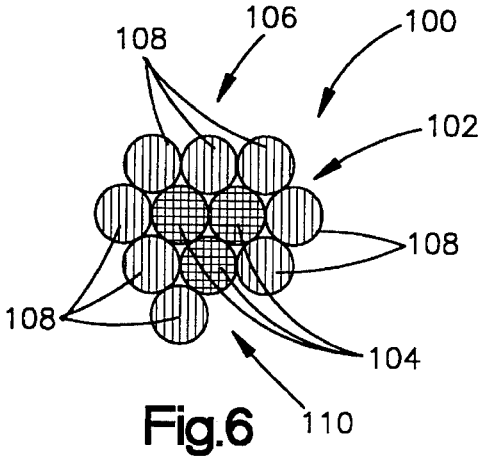
FIG. 6 is a schematic cross sectional view of a sixth embodiment of a cord in accordance with the present invention.

Referring to FIG. 6, there is illustrated a sixth embodiment of the invention wherein a 3×0.20/8×0.20+1 cord 100 having a construction of a core 102 formed of three core filaments 104, each with a diameter (dc) of 0.20 mm and a coaxial layer 106 of eight layer filaments 108, each with a diameter (dl) of 0.20 mm, laid on the core 102 to give a total of eleven filaments. The eleven filaments, three metallic core filaments 104 and eight metallic layer filaments 108, are twisted together in the same direction at the same pitch. Each of the filaments of cord 100 is formed of high strength, high carbon steel. A spiral wrap of a small wrap filament 17 of steel can be arranged about the coaxial layer 106 to hold it together and in position against core 102, if desired.

The cord 100 of the sixth embodiment is similar to the cord 52 of the third embodiment, in that both cords 100 and 52 are constructed from the same number of core and layer filaments and by the same manufacturing process as discussed above and schematically illustrated in FIG. 7. The differences between the cord 52 of the second embodiment and the cord 100 of the sixth embodiment is that the coaxial layer 106 of cord 100 is formed of eight substantially identical layer filaments 108 each having a larger diameter than the core filaments 104. By comparison, in the embodiment of FIG. 3, two of the core filaments 48 are larger than the layer filaments 54 and one of the core filaments 50 has the same size as the layer filaments 54.

To achieve the effective rubber penetration and the advantages enumerated above, it has been found advantageous for the diameter (dc) of the three metallic core filaments 104 to equal the of the diameter (dl) eight metallic layer filaments 108 of the coaxial layer 106 diameter (dl) wherein the ratio of (dc)/(dl) is 1.0. The result of constructing cord 100 with the size relationships afforded by the selection of the core and layer filament sizes and the number of .layer filaments is three spacings 110 between the layer filaments 108 which allows for direct contact of the core 102 with the calender rubber conventionally applied to the cord 100. That is, a large surface area of the layer filaments 108 is exposed, while at the same time exposing the core filaments 104 to significant rubber penetration. The rubber penetration into the spacing 110 due to the relationship of the sizes of the core filaments 104 and the layer filaments 108, has been found to provide effective interlocking between all of the filaments forming the cord 100.

The patents set forth in this specification are intended to be incorporated in their entireties by reference herein.

It is apparent that there has been provided in accordance with this invention a number of embodiments of metallic cord for the reinforcement of elastomer used in the manufacture of tires that satisfies the objects, means and advantages set forth hereinbefore.

While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and scope of the appended claims.

What is claimed is:

1. A metallic cord for the reinforcement of elastomer used in the manufacture of tires, comprising:

a core composed of three metallic core filaments twisted about each other; a coaxial layer of nine metallic layer filaments arranged around said core filaments, said metallic core filaments and said metallic layer filaments being twisted in the same direction at the same pitch, two of said metallic core filaments having a first diameter (dc) and a third of said metallic core filaments having a second diameter (dcs) smaller than said first diameter (dc) and said metallic layer filaments of said coaxial layer have a third diameter (dl) equal to said second diameter (dcs).

2. The metallic cord of claim 1, wherein said first diameter (dc) is 0.22 mm, said second diameter (dcs) of 0.20 mm and said third diameter (dl) is 0.20 mm.

3. The metallic cord of claim 2, further including a spiral wrapping filament.

4. The metallic cord of claim 1 wherein said metallic core filaments and said metallic layer filaments are of a high strength, high carbon steel having a strength between about 3700 through about 4000 Mega Pascal.

5. A metallic cord for the reinforcement of elastomer used in the manufacture of tires, consisting of:

a core composed of three metallic core filaments twisted about each other; a coaxial layer of eight metallic layer filaments arranged around the core filaments, said metallic core filaments and said metallic layer filaments being twisted in the same direction at the same pitch, two of said metallic core filaments having a first diameter (dc) and a third of said metallic core filaments having a second diameter (dcs) smaller than said first diameter (dc), and said metallic layer filaments of said coaxial layer have a diameter (dl) equal to said second diameter (dcs).

6. The metallic cord of claim 5 wherein said first diameter (dc) is 0.22 mm, said second diameter (dcs) is 0.20 mm and said third diameter (dl) is 0.20 mm.

7. The metallic cord of claim 5 wherein said metallic core filaments and said metallic layer filaments are of a high strength, high carbon steel having a strength between about 3700 through about 4000 Mega Pascal.

8. A metallic cord for the reinforcement of elastomer used in the manufacture of tires, consisting of:

a core composed of three metallic core filaments twisted about each other; a coaxial layer of eight metallic layer filaments arranged around said core filaments, said metallic core filaments and said metallic layer filaments being twisted in the same direction at the same pitch, said metallic core filaments having a first diameter (dc) and said metallic layer filaments having a second diameter (dl) equal to said first diameter (dc).

9. The metallic cord of claim 8 wherein said first diameter (dc) is 0.20 mm and said second diameter (dl) is 0.20 mm.

10. The metallic cord of claim 8 wherein said metallic core filaments and said metallic layer filaments are of a high strength, high carbon steel having a strength between about 3700 through about 4000 Mega pascal.

* * * * *